US011530073B2

(12) United States Patent
Steen

(10) Patent No.: US 11,530,073 B2
(45) Date of Patent: Dec. 20, 2022

(54) CONTAINER

(71) Applicant: Steen Products, Inc., Fort Mill, SC (US)

(72) Inventor: Robby Wayne Steen, Fort Mill, SC (US)

(73) Assignee: STEEN PRODUCTS, INC., Fort Mill, SC (US)

( * ) Notice: Subject to any disclaimer, the term of this patent is extended or adjusted under 35 U.S.C. 154(b) by 217 days.

(21) Appl. No.: 16/998,234

(22) Filed: Aug. 20, 2020

(65) Prior Publication Data

US 2022/0017264 A1 Jan. 20, 2022

Related U.S. Application Data

(60) Provisional application No. 63/053,341, filed on Jul. 17, 2020.

(51) Int. Cl.
*B65D 6/24* (2006.01)
*B65D 8/00* (2006.01)
(Continued)

(52) U.S. Cl.
CPC ..... *B65D 11/1866* (2013.01); *B65D 11/04* (2013.01); *B65D 11/20* (2013.01); *B65D 47/063* (2013.01); *B65D 2547/066* (2013.01)

(58) Field of Classification Search
CPC ..... B65D 11/1866; B65D 11/04; B65D 11/20; B65D 47/063; B65D 2547/066;
(Continued)

(56) References Cited

U.S. PATENT DOCUMENTS 3,845,884 A 11/1974 Hall et al.
4,236,655 A 12/1980 Humphries
(Continued)

FOREIGN PATENT DOCUMENTS

DE 1217852 5/1966
DE 3032184 A1 4/1982
(Continued)

OTHER PUBLICATIONS

Notification Regarding Certain Corrections made Ex Officio from the International Searching Authority for related PCT Application No. PCT/US2020/049916, dated Sep. 18, 2020, 6 pages. The receiving Office has corrected formal defects in the international application, as shown on the attached copy of the request, sheet No. 6.

(Continued)

*Primary Examiner* — Kareen K Thomas
(74) *Attorney, Agent, or Firm* — Shumaker, Loop & Kenderick, LLP; S. Alexander Long, Jr.

(57) ABSTRACT

A container including a container body adapted for containing a liquid for storage and dispensing through an opening in the container body. An exterior recess is formed a wall of the container body and defines a location for a pour spout in a stowed position. The pour spout is attached to the container body and is movable between the stowed position within the recess and a deployed use position in liquid dispensing communication with the opening in the container body.

19 Claims, 9 Drawing Sheets

(51) Int. Cl.
*B65D 47/06* (2006.01)
*B65D 6/00* (2006.01)

(58) Field of Classification Search
CPC .. B65D 25/46; B65D 47/065; B65D 47/2043; B65D 47/2031; B65D 47/2012; B65D 47/2006; B65D 47/16; B65D 5/746; B65D 5/745; B65D 5/743; B65D 5/742; B65D 5/74; B65D 25/40; B65D 25/38; B65D 25/42; B65D 69/00; B65D 23/12; B67C 11/02
See application file for complete search history.

(56) References Cited

U.S. PATENT DOCUMENTS

| | | | | |
|---|---|---|---|---|
| 4,243,162 | A | 1/1981 | Klygis | |
| 4,488,584 | A | 12/1984 | Hestehave et al. | |
| 4,583,668 | A | 4/1986 | Maynard, Jr. | |
| 4,901,878 | A | 2/1990 | Humphries | |
| D307,547 | S | 5/1990 | Humphries | |
| 5,101,870 | A * | 4/1992 | Farris | B65D 1/02 215/390 |
| 5,400,928 | A | 3/1995 | Resnick | |
| 5,454,483 | A | 10/1995 | Ichikawa et al. | |
| D414,115 | S | 9/1999 | Goettner | |
| 7,048,150 | B2 | 5/2006 | Barnett et al. | |
| 8,118,198 | B1 | 2/2012 | Watson | |
| D696,127 | S | 12/2013 | Juna | |
| 8,833,617 | B1 | 9/2014 | Compton et al. | |
| 9,335,085 | B2 | 5/2016 | Persson et al. | |
| 9,365,320 | B1 * | 6/2016 | Erickson | B23P 17/00 |
| D762,120 | S | 7/2016 | Valentine | |
| D762,477 | S | 8/2016 | Valentine | |
| 9,439,551 | B1 * | 9/2016 | Atkinson | B05B 15/30 |
| D790,970 | S | 7/2017 | Bos | |
| D790,971 | S | 7/2017 | Bos | |
| 9,783,339 | B1 | 10/2017 | Atkinson et al. | |
| D813,679 | S | 3/2018 | Bos | |
| 10,059,501 | B2 * | 8/2018 | Bogenrief | B65D 81/18 |
| 10,124,930 | B2 | 11/2018 | Sessions | |
| D835,991 | S | 12/2018 | Veldhuis | |
| D857,508 | S | 8/2019 | Uetsuki | |
| D888,197 | S | 6/2020 | McDonnell | |
| 10,822,147 | B2 | 11/2020 | Bongiovanni | |
| 2001/0030203 | A1 * | 10/2001 | Weber | B05B 11/0037 222/464.7 |
| 2006/0186144 | A1 * | 8/2006 | Tinsley | B05B 15/30 222/464.7 |
| 2009/0107582 | A1 * | 4/2009 | Sayage | B65D 51/24 141/340 |
| 2010/0181390 | A1 * | 7/2010 | Huang | A47L 13/51 239/289 |
| 2015/0108179 | A1 * | 4/2015 | Dandreo | B65D 25/46 222/535 |
| 2017/0327281 | A1 | 11/2017 | Cross | |
| 2021/0171245 | A1 * | 6/2021 | Crosby | B65D 47/088 |

FOREIGN PATENT DOCUMENTS

| | | | |
|---|---|---|---|
| DE | 202005006134 | U1 | 7/2005 |
| EP | 3816062 | A1 | 5/2021 |
| GB | 2551613 | | 12/2017 |

OTHER PUBLICATIONS

PCT International Search Report and Written Opinion cited in International Application No. PCTUS2021027262; dated Jul. 20, 2021; 10 pages.
PCT International Search Report and Written Opinion cited in International Application No. PCTUS2020049916; dated Nov. 20, 2020; 9 pages.

* cited by examiner

CONTAINER

PRIORITY CLAIM

This utility patent application claims priority from U.S. Provisional Application No. 63/053,341, filed on Jul. 17, 2020, the contents of which are incorporated by reference in this application.

TECHNICAL FIELD AND BACKGROUND OF THE INVENTION

This invention relates to containers of a type particularly suited to contain liquids such as motor oil, brake and transmission fluids and similar liquid products used in in transportation, such as motor vehicles, aircraft, as well as construction and mining equipment and the like. In many instances, replenishment of such oils and fluids can result in spillage due to the small size of filler tubes into which the oils or fluids must be poured. Funnels can be used, but because they are not part of or associated with the container, they may not be available when needed, or even if available, not used as intended. The result can be wasted product and contamination of the area surrounding where the products are dispensed from the container.

HDPE is the most widely used resin for plastic containers of the type that is the subject of this application. This material is economical, impact resistant, and provides a good moisture barrier. HDPE is compatible with a wide range of products including oils, acids and caustics. However, the novel container disclosed in this application is not limited to any specific material or any specific end use but can be used in any environment including medical, food service, military, agricultural, industrial and other end uses based on selection of the appropriate plastic material, size, wall thickness and other factors. Materials other than HDPE can, without limitation, include Fluorine-treated HDPE, Low-density polyethylene (LDPE), Polyethylene terephthalate (PET, PETE)/Polyester, Polycarbonate (PC), Polypropylene (PP), Polystyrene (PS), Polyvinyl chloride (PVC), Post-consumer resin (PCR).

PCR is a blend of reclaimed natural HDPE (primarily from milk and water containers) and virgin resin. The recycled material is cleaned, ground and re-compounded into uniform pellets along with prime virgin material especially designed to build up environmental stress crack resistance. Other suitable materials include K-Resin (SBC), Bioplastic, and Bisphenol A (BPA).

BPA is a synthetic compound that serves as a raw material in the manufacturing of such plastics as polycarbonates and epoxy resins. It is commonly found in reusable drink containers, food storage containers, canned foods, children's toys and cash register receipts. Many of these materials lend themselves to be recycled and fabricated into various post-consumer products.

SUMMARY OF THE INVENTION

It is therefore an object of the present invention to provide a container that includes a spout to facilitate pouring of the contents from the container without spillage.

It is another object of the present invention to provide a container that is usable in a wide range of applications.

It is another object of the present invention to provide a container that includes a spout that is integral with the body of the container.

It is another object of the present invention to provide a container that includes a spout that in a stowed position fits within the overall area occupied by the body of the container.

It is another object of the present invention to provide a container that includes a spout that may be moved between a stowed position and a use position repeatedly without material fatigue.

It is another object of the present invention to provide a container that includes a spout that is deployable for use and stowable with the container for later use.

It is another object of the present invention to provide a container that is reusable and easily recyclable.

These and other objects and advantages of the invention are achieved by providing a container that includes a container body adapted for containing a liquid for storage and dispensing through an opening in the container body with an exterior recess formed in a wall of the container body and defining a location for a pour spout in a stowed position. The pour spout is attached to the container body and movable between the stowed position within the recess and a deployed use position in liquid dispensing communication with the opening in the container body.

According to another aspect of the invention, a pair of slide grooves is positioned on opposite sides of, and proximate to, the opening of the container body and the exterior recess, and the pour spout includes a pair of tabs adapted for being positioned in respective ones of the slide grooves and movable for both pivoting and translating the pour spout from its stowed position into its deployed use position in liquid dispensing communication with the opening in the container body.

According to another aspect of the invention, the pour spout includes a funnel that is positioned in the exterior recess when the pour spout is in the stowed position, and is positioned in the liquid dispensing communication with the opening in the container body in the deployed use position.

According to another aspect of the invention, the pour spout includes a funnel that is positioned in the exterior recess when the pour spout is in the stowed position, and is positioned in liquid dispensing communication with the opening in the container body when in the deployed use position. A flexible spout is provided in flow communication with the funnel and includes an exit opening through which contents of the container are dispensed.

According to another aspect of the invention the flexible spout includes a collapsed position for being stowed in the exterior recess and an extended position for dispensing contents from the container.

According to another aspect of the invention, the flexible spout includes a plurality of concentric accordion folds by which the flexible spout is adapted to be collapsed from the extended dispensing position into its stowed position and to be extended from the stowed position into its extended dispensing position.

According to another aspect of the invention, the opening in the container is threaded and is adapted to receiving a sealing cap having complementary threads.

According to another aspect of the invention, the exterior recess includes a pair of laterally spaced-apart and recessed container walls.

According to another aspect of the invention, the exterior recess includes a pair of laterally spaced-apart and recessed container walls extending diagonally from a relatively large area lower position proximate a base of the container to a relatively small area upper position proximate the opening of the container.

According to another aspect of the invention, the pair of laterally spaced-apart and recessed container walls defines between them a centrally positioned deep recess zone for containing the pour spout in its stowed position.

According to another aspect of the invention, the pair of laterally spaced-apart and recessed container walls defines between them a centrally positioned deep recess zone having a shape corresponding to a shape of the pour spout in its stowed position for containing the pour spout in its stowed position.

According to another aspect of the invention, the pour spout includes a funnel that is positioned in the exterior recess when the pour spout is in the stowed position and is positioned in the liquid dispensing communication over the opening in the container body in the deployed use position and includes walls that engage the container around the opening in the container body and support the funnel in liquid dispensing communication with the opening in the container body.

According to another aspect of the invention, the exterior recess defines a V-shaped notch in the container body between a base of the container and the opening in the container body.

According to another aspect of the invention, the pour spout is detachable from the container body.

According to another aspect of the invention, a container is provided and includes a container body adapted for containing a liquid for storage and dispensing through an opening in the container body with an exterior recess formed in a wall of the container body and defining a location for a pour spout in a stowed position. The pour spout is attached to the container body and is movable between the stowed position within the recess and a deployed use position in liquid dispensing communication with the opening in the container body. A pair of slide grooves is positioned on opposite sides of, and proximate to, the opening of the container body and the exterior recess. The pour spout includes a pair of tabs adapted for being positioned in respective ones of the slide grooves and movable in the respective ones of the slide grooves for both pivoting and translating the pour spout from its stowed position into its deployed use position in liquid dispensing communication with the opening in the container body. The pour spout includes a funnel that is positioned in the exterior recess when the pour spout is in the stowed position and is positioned in the liquid dispensing communication with the opening in the container body in the deployed use position. The pour spout includes a flexible spout in flow communication with the funnel, an exit opening through which contents of the container are dispensed, and a plurality of concentric accordion folds by which the flexible spout is adapted to be collapsed from the extended dispensing position into its stowed position and to be extended from the stowed position into its extended dispensing position.

According to another aspect of the invention, the container body is plastic.

According to another aspect of the invention, the container body is selected from the group of materials consisting of HDPE, Fluorine-treated HDPE, low-density polyethylene (LDPE), polyethylene terephthalate (PET, PETE)/polyester, polycarbonate (PC), polypropylene (PP), polystyrene (PS), polyvinyl chloride (PVC), post-consumer resin (PCR), K-Resin (SBC), Bioplastic, and Bisphenol A (BPA).

According to another aspect of the invention, the exterior recess defines a V-shaped notch between a base of the container and the opening in the container body.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT AND BEST MODE

Figure 1:
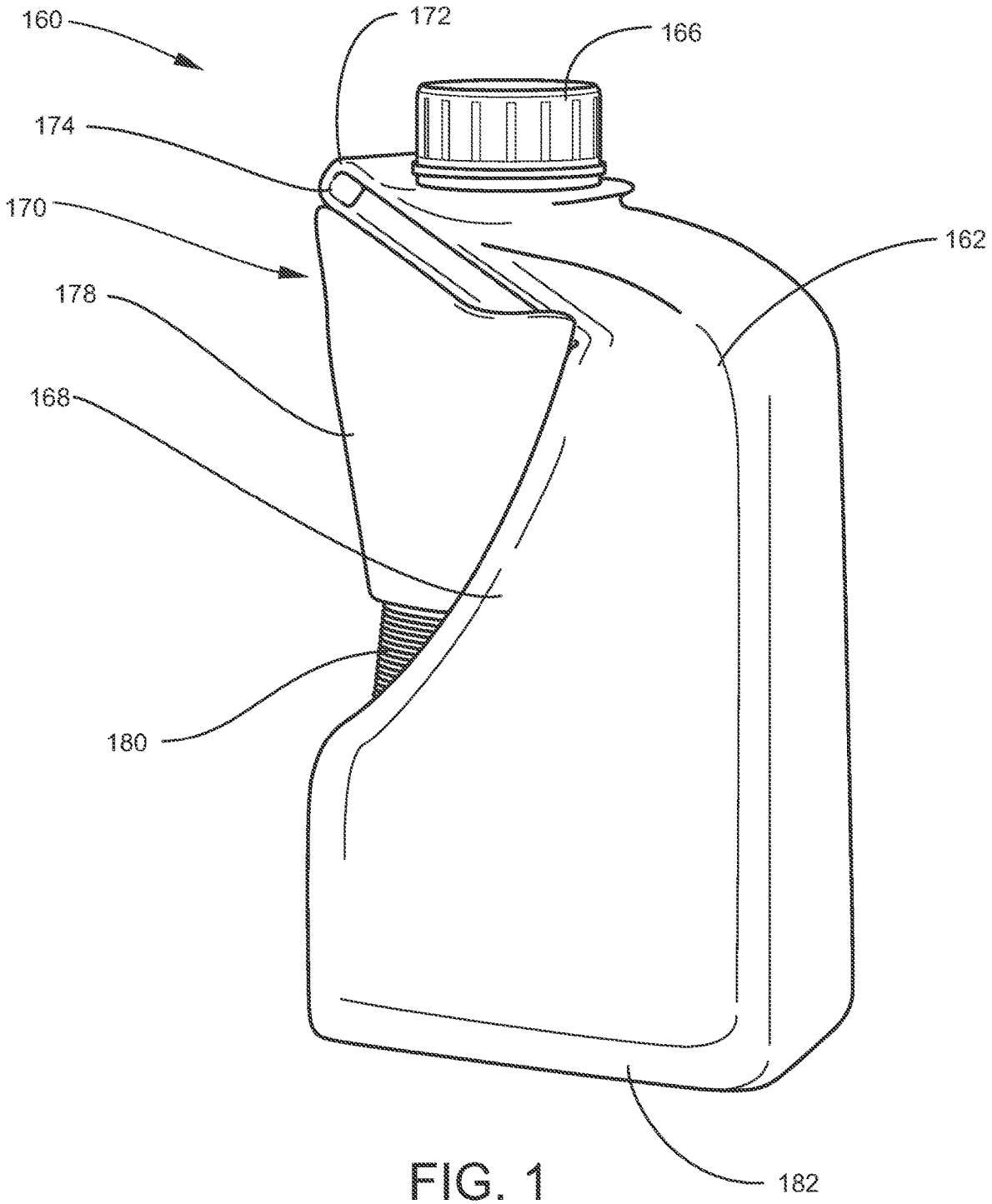
FIG. 1 is a perspective view of a container according to a preferred embodiment of the invention with the pour spout in the stowed position.
Figure 2:
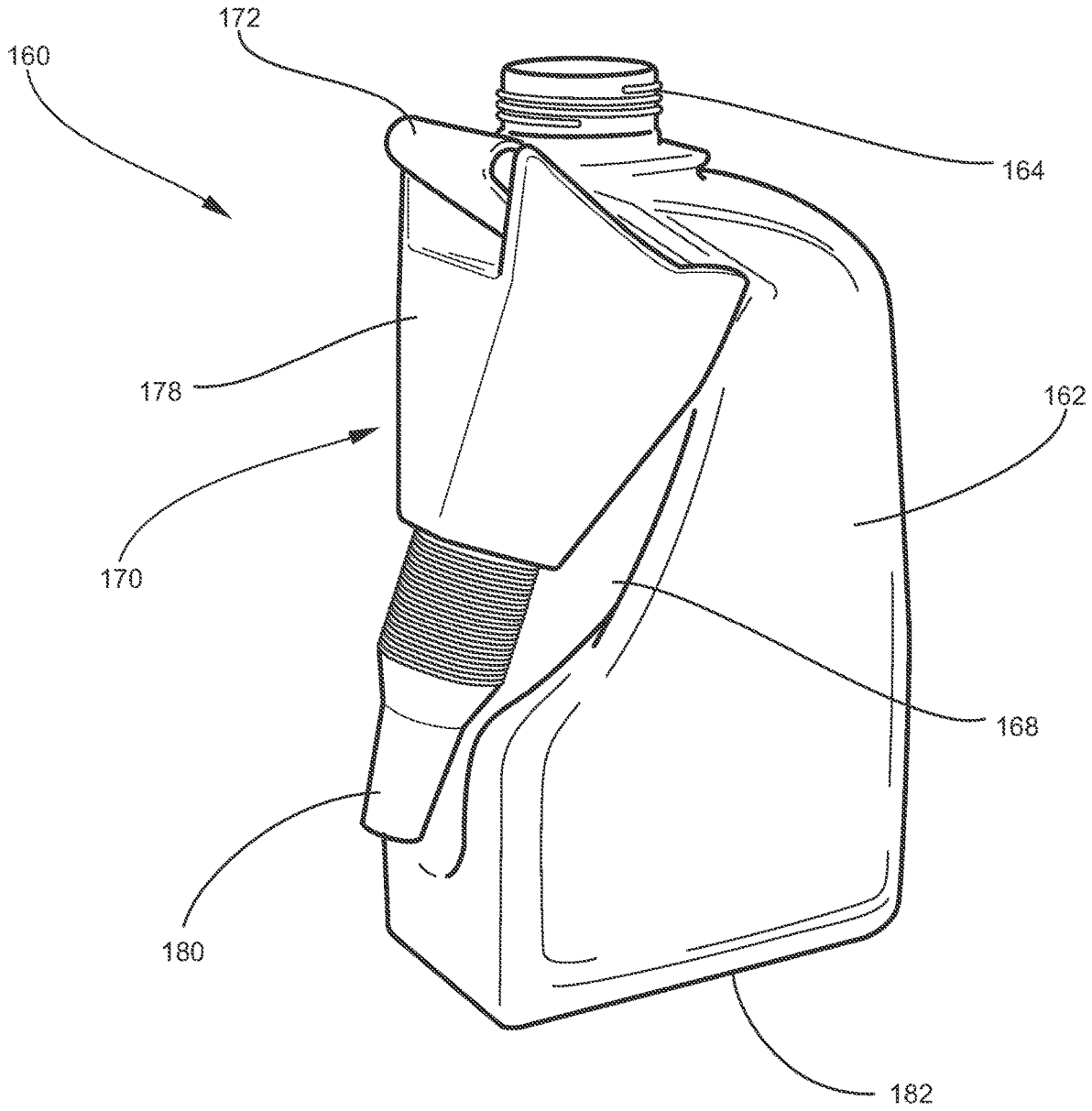
FIGS. 2-7 are sequential perspective views showing the pour spout being deployed from the stowed position of FIG. 1 into the use position.
Figure 3:
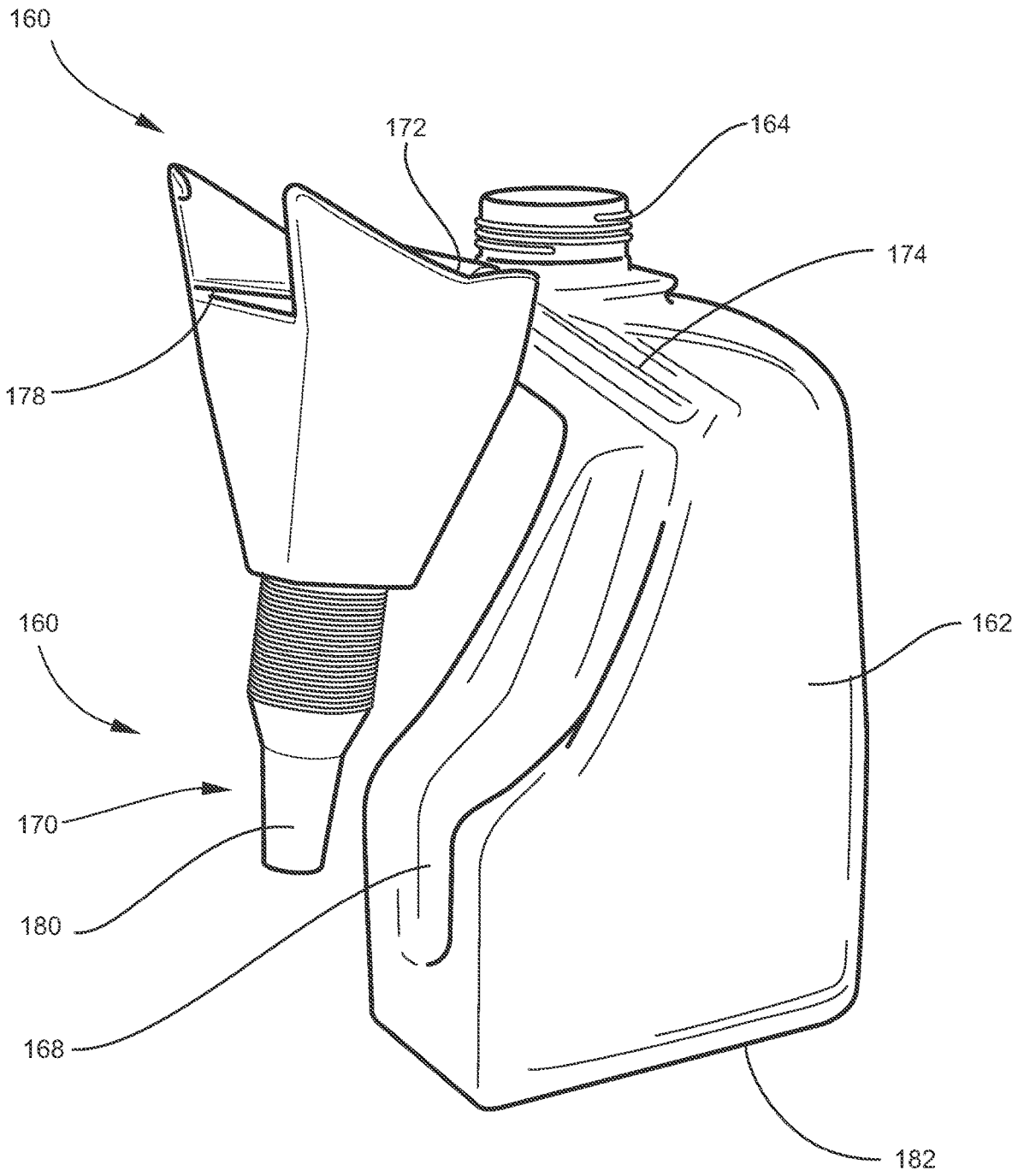
Figure 4:
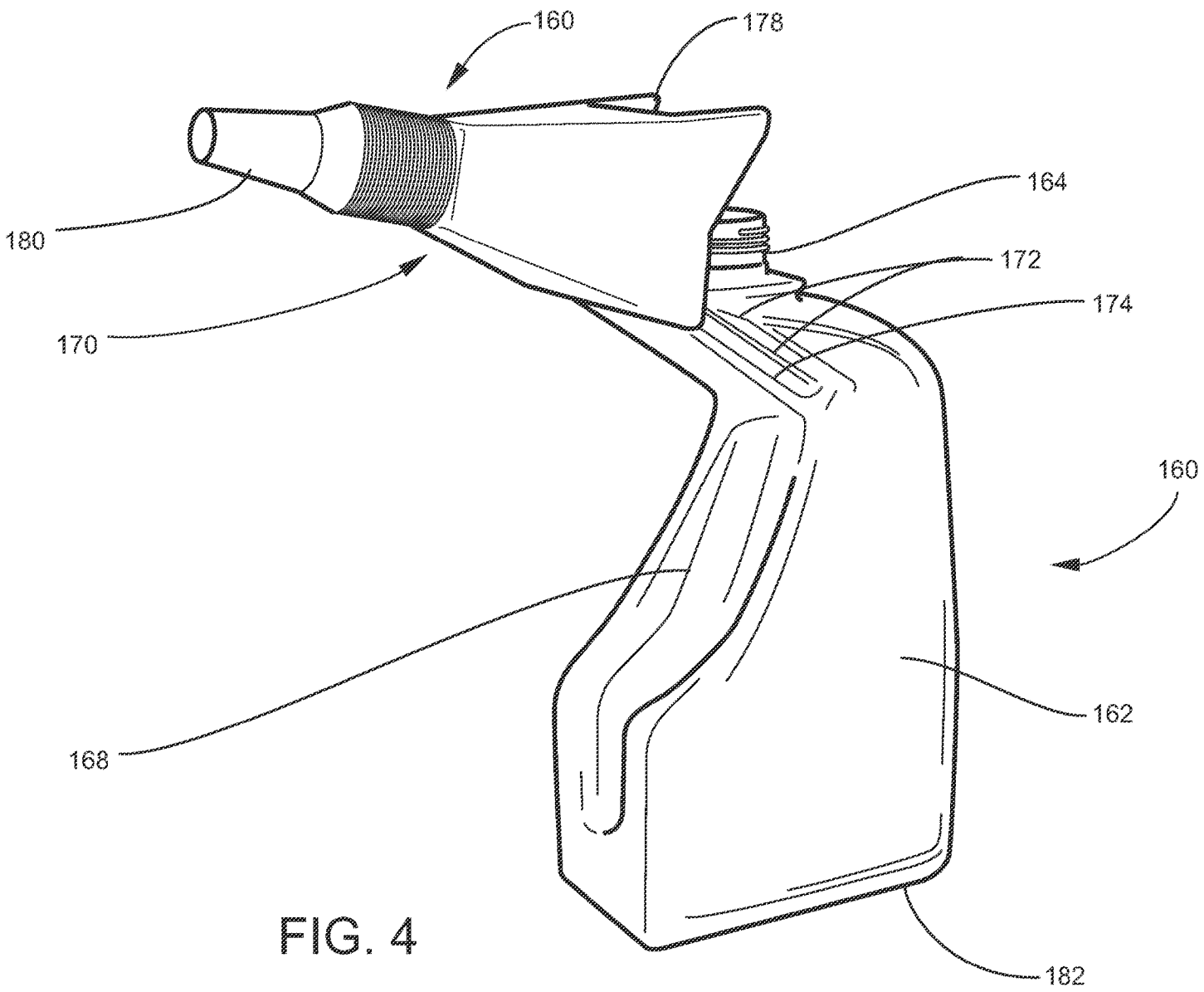
Figure 5:
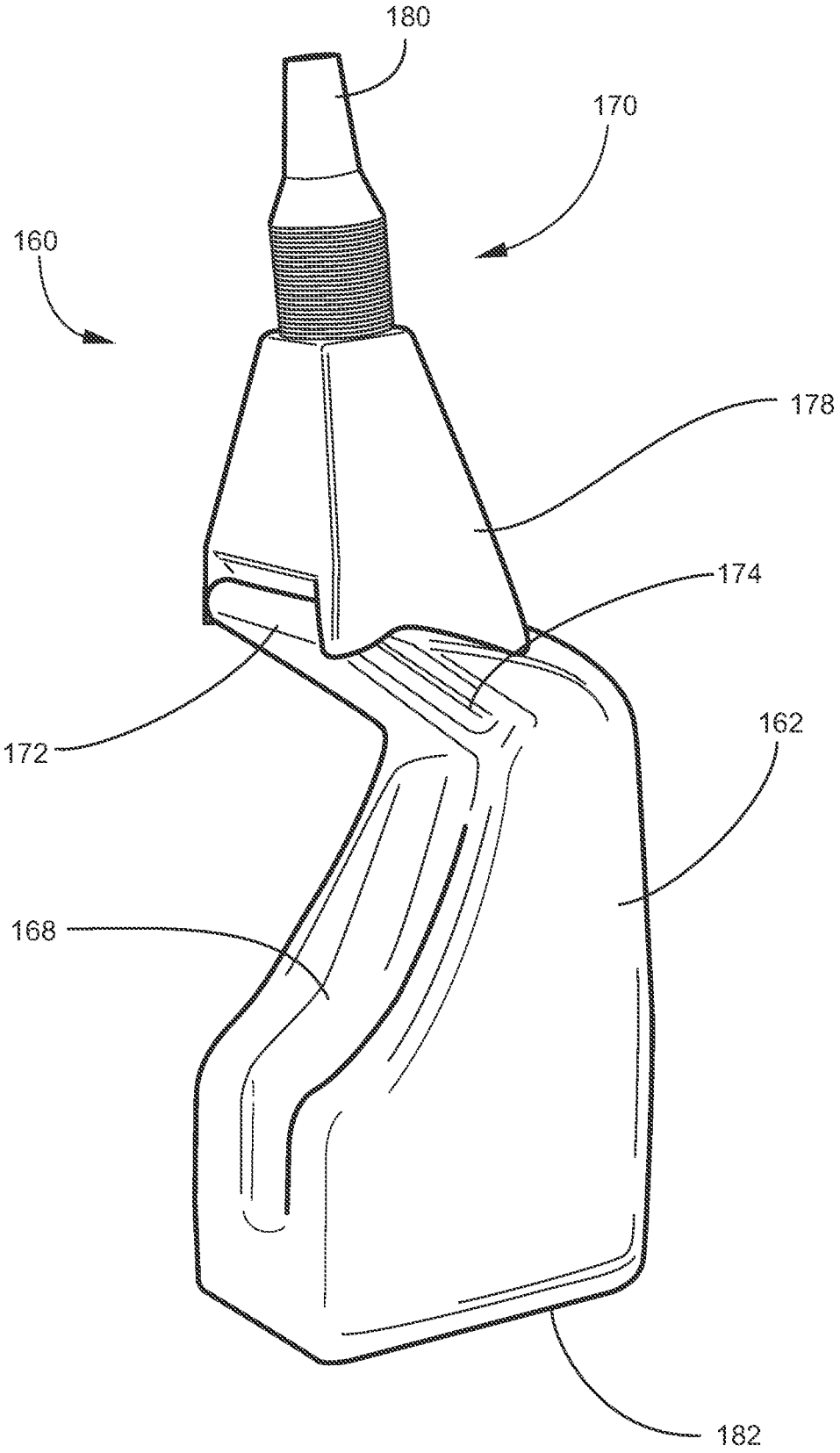
Figure 6:
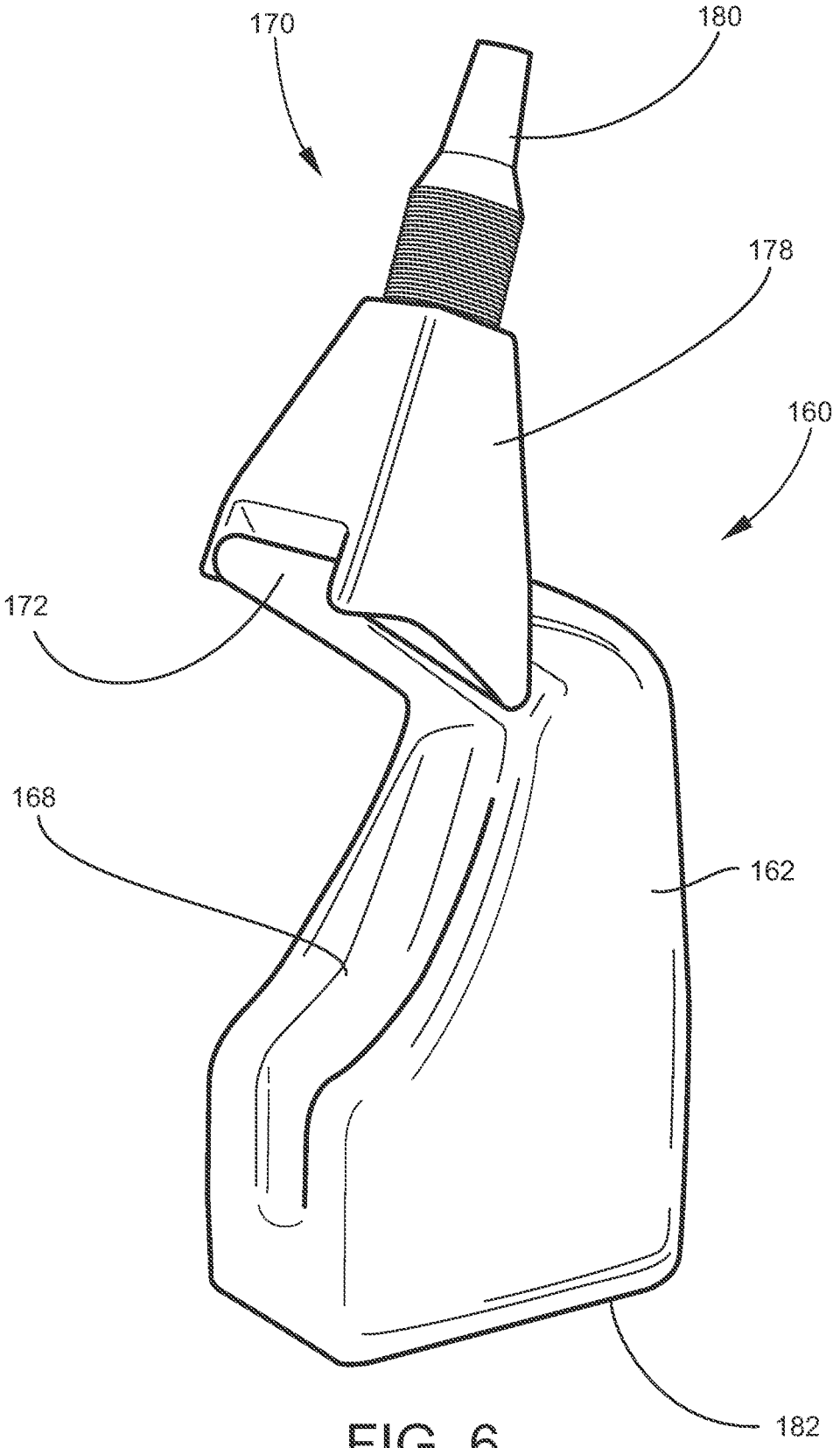

Referring to FIGS. 1-9, a container 160 is shown, and includes a container body 162 with a threaded top opening 164 for receiving a threaded cap 166. The body 162 includes a deep exterior recess 168 into which is positioned a pour spout 170. The recess 168 defines a V-shaped notch that extends from a position above the base 182 to a position proximate to and below the top opening 164.

The pour spout 170 is shaped to generally conform to the shape of the recess 168, as best shown in FIG. 1. The container body 162 includes an integrally-molded slide member 172 having a pair of opposed slide grooves 174 (one shown).

Figure 7:
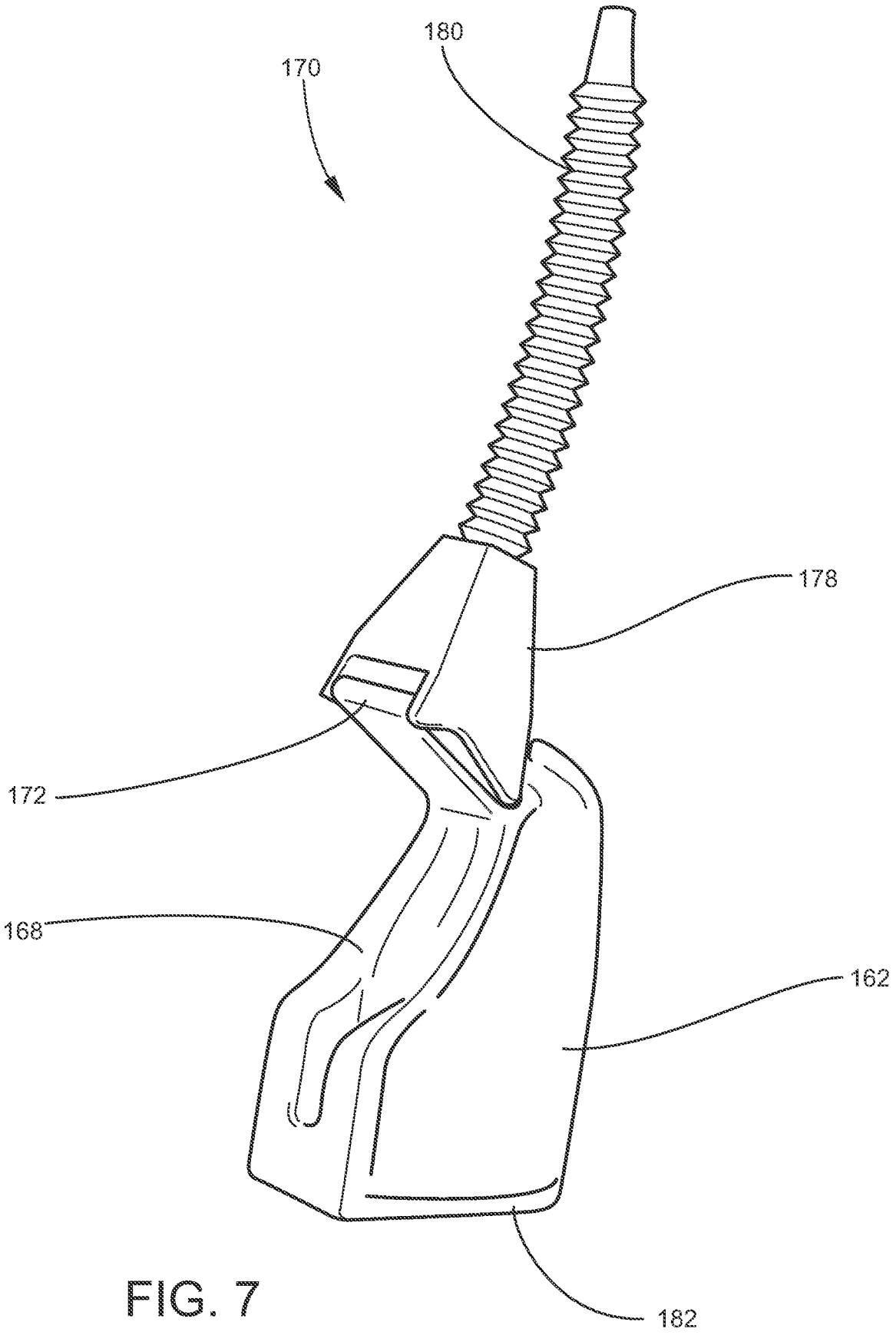
Figure 9:
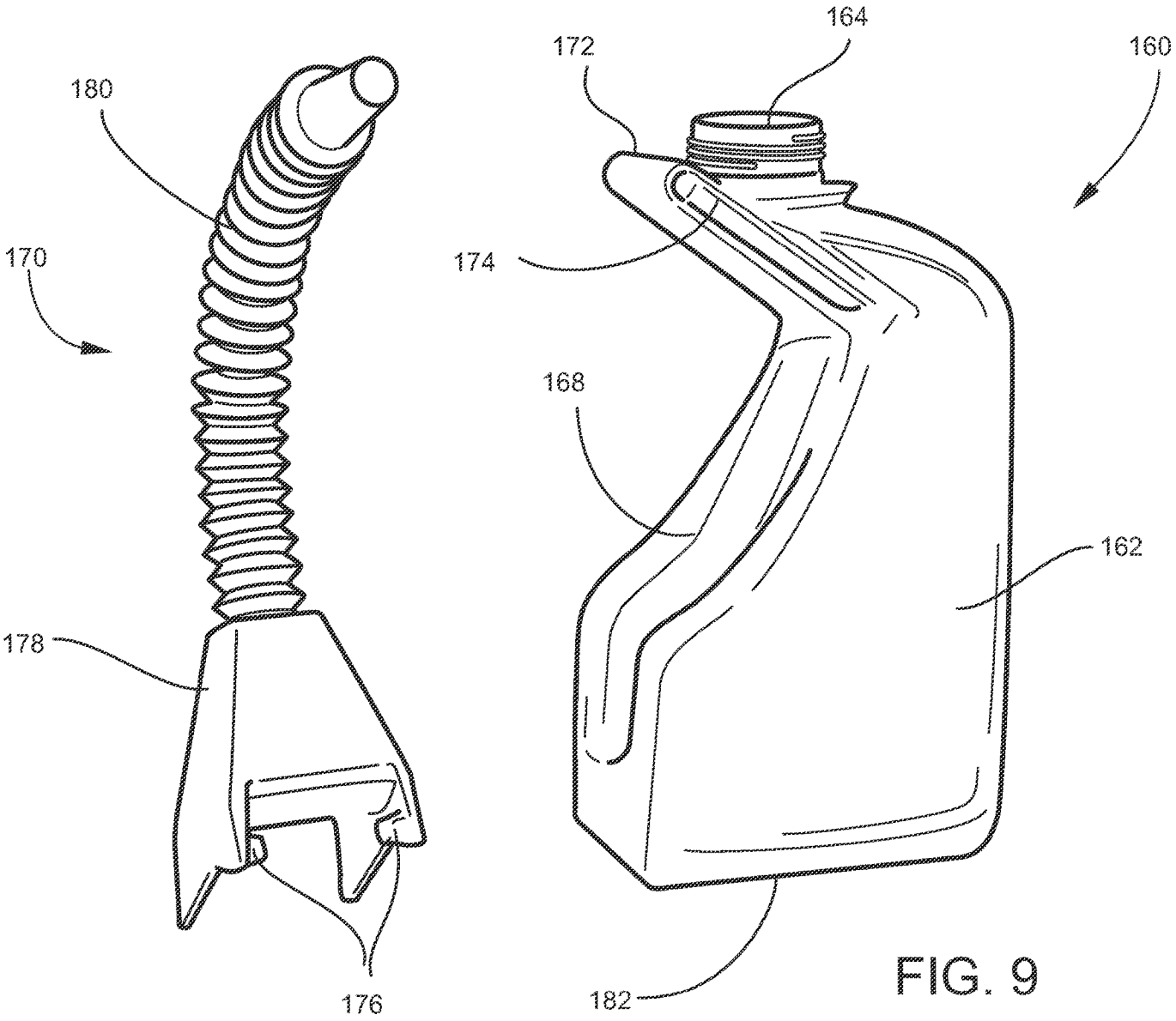
FIG. 9 is a perspective view with the pour spout separated from the container body to show the details of the slide member.

As shown in FIG. 9, the pour spout 170 includes a pair of tabs 176 that fit into respective ones of the slide grooves 174 and are adapted to both pivot in the slide grooves 174 and translate along the length of the slide grooves 174 as the pour spout 170 translates from its stowed position of FIG. 1 into the use position of FIG. 7. This enables a very compact, stable configuration that nevertheless permits a stowed position of the pour spout 170 fully within the perimeter of the container 160 while at the same time allowing the pour spout 170 to move to a use position while remaining fully attached to the container body 162. Movement between the stowed position of FIG. 1 and use position of FIG. 7 can be performed repeatedly as the contents of the container are dispensed without the pour spout 170 being removed, and without sustaining wear fatigue.

Referring to FIGS. 1-7, the pour spout 170 is shown moving sequentially from the stowed position of FIG. 1 into the use position of FIG. 7. The pour spout 170 includes a funnel 178 that transitions to a flexible spout 180. In the use position of FIG. 7 the funnel 178 fits snugly over the threaded top opening 164 whereby the liquid contents of the container 160 dispense directly into the funnel 178 and then down the flexible spout 180.

Figure 8:
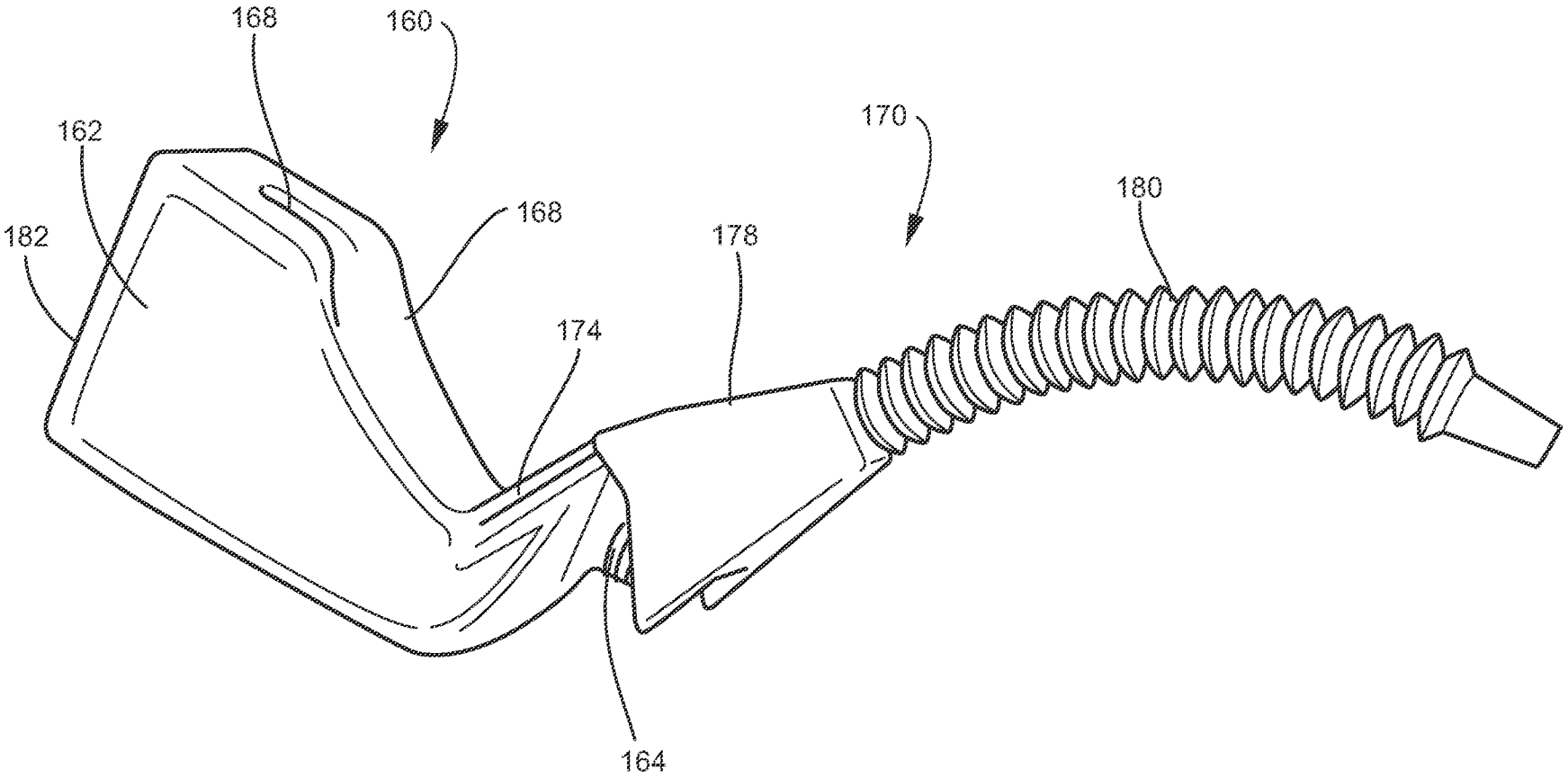
FIG. 8 is a perspective view showing the pour spout moved away from its deployed use position.

As shown in FIG. 8, the pour spout 170 is returned to its stowed position by pivoting and translating the funnel away from the opening 164.

As best shown in FIGS. 1-6, the flexible spout 180 has an "accordion" type configuration that allows it in its stowed position to be collapsed into a short length that nests fully within the recess 168. When in the use position of FIG. 7 the flexible spout 180 is grasped and pulled away from the funnel 178 into the extended position shown. The flexible spout 180 can be bent as needed to facilitate introduction of the end of the flexible spout 180 into a receptacle opening into which the contents of the container 160 are being dispensed. To return the pour spout 170 to its stowed position, the sequence of FIGS. 1-7 is reversed, including collapsing the flexible spout 180 back into the configuration shown in FIG. 1.

As shown in FIG. 9, the pour spout 170 is detachable from the container 160. This is accomplished by spreading the walls of the funnel 178 sufficiently to remove the tabs 176 from the slide grooves 174. The pour spout 170 can be reinstalled on the container 160 by reversing the process.

A container has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

I claim:

1. A container, comprising:

a container body adapted for containing a liquid for storage and dispensing through an opening in the container body;

an exterior recess formed in a wall of the container body and defining a location for a pour spout in a stowed position;

the pour spout attached to the container body and movable between the stowed position within the recess and a deployed use position in liquid dispensing communication with the opening in the container body;

a pair of slide grooves positioned on opposite sides of and proximate to the opening of the container body and the exterior recess; and the pour spout including a pair of tabs adapted for being positioned in respective ones of the slide grooves and movable for both pivoting and translating the pour spout from its stowed position into its deployed use position in liquid dispensing communication with the opening in the container body.

2. A container according to claim 1, wherein the pour spout includes a funnel that is positioned in the exterior recess when the pour spout is in the stowed position, and is positioned in the liquid dispensing communication with the opening in the container body in the deployed use position.

3. A container according to claim 1, wherein the pour spout includes:

a funnel that is positioned in the exterior recess when the pour spout is in the stowed position, and is positioned in liquid dispensing communication with the opening in the container body when in the deployed use position; and a flexible spout in flow communication with the funnel and including an exit opening through which contents of the container are dispensed.

4. A container according to claim 1, wherein the flexible spout includes a collapsed position for being stowed in the exterior recess and an extended position for dispensing contents from the container.

5. A container according to claim 4, wherein the flexible spout includes a plurality of concentric accordion folds by which the flexible spout is adapted to be collapsed from the extended dispensing position into its stowed position and to be extended from the stowed position into its extended dispensing position.

6. A container according to claim 2, wherein the opening in the container is threaded and is adapted to receiving a sealing cap having complementary threads.

7. A container according to claim 1, wherein the exterior recess includes a pair of laterally spaced-apart and recessed container walls.

8. A container according to claim 7, wherein the exterior recess includes a pair of laterally spaced-apart and recessed container walls extending diagonally from a relatively large area lower position proximate a base of the container to a relatively small area upper position proximate the opening of the container.

9. A container according to claim 8, wherein the pair of laterally spaced-apart and recessed container walls define between them a centrally positioned deep recess zone for containing the pour spout in its stowed position.

10. A container according to claim 8, wherein the pair of laterally spaced-apart and recessed container walls define between them a centrally positioned deep recess zone having a shape corresponding to a shape of the pour spout in its stowed position for containing the pour spout in its stowed position.

11. A container according to claim 1, wherein the pour spout includes a funnel that is positioned in the exterior recess when the pour spout is in the stowed position and is positioned in the liquid dispensing communication over the opening in the container body in the deployed use position and includes walls that engage the container around the opening in the container body and support the funnel in liquid dispensing communication with the opening in the container body.

12. A container according to claim 1, wherein the exterior recess defines a V-shaped notch in the container body between a base of the container and the opening in the container body.

13. A container according to claim 1, wherein the pour spout is detachable from the container body.

14. A container including:

(a) a container body adapted for containing a liquid for storage and dispensing through an opening in the container body;

(b) an exterior recess formed in a wall of the container body and defining a location for a pour spout in a stowed position;

(c) the pour spout attached to the container body and movable between the stowed position within the recess and a deployed use position in liquid dispensing communication with the opening in the container body;

(d) a pair of slide grooves positioned on opposite sides of and proximate to the opening of the container body and the exterior recess;

(e) the pour spout including a pair of tabs adapted for being positioned in respective ones of the slide grooves and movable in the respective ones of the slide grooves for both pivoting and translating the pour spout from its stowed position into its deployed use position in liquid dispensing communication with the opening in the container body;

(f) the pour spout including a funnel that is positioned in the exterior recess when the pour spout is in the stowed position and is positioned in the liquid dispensing communication with the opening in the container body in the deployed use position; and (g) the pour spout including a flexible spout in flow communication with the funnel and including an exit opening through which contents of the container are dispensed, and including a plurality of concentric accordion folds by which the flexible spout is adapted to be collapsed from the extended dispensing position into its stowed position and to be extended from the stowed position into its extended dispensing position.

15. A container according to claim 14, wherein the exterior recess includes a pair of laterally spaced-apart and recessed container walls.

16. A container according to claim 14, wherein the exterior recess includes a pair of laterally spaced-apart and recessed container walls extending diagonally from a relatively large area lower position proximate a base of the container to a relatively small area upper position proximate the opening of the container.

17. A container according to claim 14, wherein the container body is plastic.

18. A container according to claim 14, wherein the container body is selected from the group of materials consisting of HDPE, Fluorine-treated HDPE, low-density polyethylene (LDPE), polyethylene terephthalate (PET, PETE)/polyester, polycarbonate (PC), polypropylene (PP), polystyrene (PS), polyvinyl chloride (PVC), post-consumer resin (PCR), K-Resin (SBC), Bioplastic, and Bisphenol A (BPA).

19. A container according to claim 14, wherein the exterior recess defines a V-shaped notch between a base of the container and the opening in the container body.

* * * * *